US010661122B1

(12) United States Patent
Banks

(10) Patent No.: US 10,661,122 B1
(45) Date of Patent: May 26, 2020

(54) WATER-TIGHT EXPANDABLE SWIM CAP WITH CINCHING FEATURE

(71) Applicant: Candice Danielle Banks, Bowie, MD (US)

(72) Inventor: Candice Danielle Banks, Bowie, MD (US)

( * ) Notice: Subject to any disclaimer, the term of this patent is extended or adjusted under 35 U.S.C. 154(b) by 37 days.

(21) Appl. No.: 15/969,209

(22) Filed: May 2, 2018

(51) Int. Cl.
*A63B 33/00* (2006.01)
*A42B 1/22* (2006.01)
*A42B 1/12* (2006.01)

(52) U.S. Cl.
CPC ..... *A63B 33/00* (2013.01); *A42B 1/12* (2013.01); *A42B 1/22* (2013.01)

(58) Field of Classification Search
CPC ..... A63B 33/00; A42B 1/12; A42B 1/22
See application file for complete search history.

(56) References Cited

U.S. PATENT DOCUMENTS 1,577,945 A * 3/1926 Blumenthal ..... A42B 1/12 2/174
1,771,178 A * 7/1930 Howland ..... A42B 1/12 2/68
1,920,387 A * 8/1933 Harper ..... A42B 1/12 2/68
2,255,708 A * 9/1941 Laughton ..... A42B 1/045 132/274
2,282,220 A * 5/1942 Gage ..... A42B 1/12 2/68
2,505,359 A * 4/1950 Hurt ..... A42B 1/12 2/68
2,533,444 A * 12/1950 Feldman ..... A42B 1/12 2/68
3,009,159 A * 11/1961 Emmet ..... A42B 1/12 2/171.01
3,113,321 A * 12/1963 Siegel ..... A45D 8/40 2/174
3,237,209 A * 3/1966 Gettinger ..... A42B 1/041 2/171.04
3,381,305 A 5/1968 Buzzelli
3,503,076 A 3/1970 Marks
3,996,621 A 12/1976 Martienssen
4,459,706 A * 7/1984 Smith ..... A42C 1/00 2/200.3
5,566,689 A 10/1996 Yeater
D448,917 S * 10/2001 Grant ..... D2/867
6,345,395 B1 * 2/2002 Chilton ..... A42B 1/12 2/171.02

(Continued)

*Primary Examiner* — Kristen Matter

(57) ABSTRACT

One or more embodiments of an elongated swim cap concavity (11*a*) having expandable walls (11) with flexible pleats (11*b*) above a draw cord sleeve (13) or (17) containing a draw cord (14) with knotted draw cord ends (15) and attached draw cord accessories (18) extending from draw cord sleeve openings (16) at the back and above an elastic ribbed perimeter band (12) with a plurality of grooved channels with ear notches (12*a*). These aspects provide a swim cap that accommodates various hair types, particularly thick, curly, long, kinky, coarse, voluminous and/or high-maintenance hair and/or chemically treated hair and/or braids, rolled locks or dreadlocks to establish and maintain a water-tight seal, a secure and stable fit, and a streamlined profile. Aesthetic possibilities are provided with visibility of and unobstructed access to the ears. Other embodiments are described and shown.

2 Claims, 7 Drawing Sheets

(56) References Cited

U.S. PATENT DOCUMENTS

| | | | | |
|---|---|---|---|---|
| 6,966,068 | B2 * | 11/2005 | Johnson | A42B 1/12 2/200.2 |
| D720,120 | S * | 12/2014 | Simmonds | D2/867 |
| 9,538,799 | B2 | 1/2017 | Dodd | |
| 9,555,288 | B1 | 1/2017 | Lucas | |
| 2005/0175805 | A1 | 8/2005 | Hild et al. | |
| 2006/0266754 | A1 | 11/2006 | Carmona | |
| 2012/0079643 | A1 * | 4/2012 | Clarke | A42B 1/041 2/171 |
| 2013/0247269 | A1 * | 9/2013 | Alburg | A42B 1/12 2/68 |
| 2014/0101821 | A1 * | 4/2014 | Dammann | A42B 1/22 2/171.4 |
| 2015/0000002 | A1 * | 1/2015 | Brown | A42B 1/12 2/68 |
| 2015/0209621 | A1 | 1/2015 | Cason et al. | |
| 2015/0150327 | A1 * | 6/2015 | Scott | A42B 1/12 2/68 |
| 2016/0066639 | A1 * | 3/2016 | Brown | A42B 1/12 2/68 |
| 2016/0100648 | A1 * | 4/2016 | De Jesu | A42B 1/12 2/174 |
| 2017/0042267 | A1 | 2/2017 | Guice | |
| 2018/0369646 | A1 * | 12/2018 | Cason | A63B 33/00 |
| 2019/0045902 | A1 * | 2/2019 | Baker | A45D 8/40 |

* cited by examiner 16
12
14
18
15

WATER-TIGHT EXPANDABLE SWIM CAP WITH CINCHING FEATURE

CROSS-REFERENCE TO RELATED APPLICATIONS

This application is related to U.S. provisional application 62/602,681, filed May 3, 2017, which is incorporated by reference in its entirety.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Field of the Invention

The present invention relates to a head covering, and more specifically to an expandable water-tight cap with adjustable features as protection for hair from water exposure while swimming and participating in water-sourced activities.

Description of Related Art

In the beginning, swim caps accommodated hair types that easily flatten when dry or wet such as Types 1 and 2. The dimensions on the swim cap concavities on standard latex and silicone adult swim caps average 21.5 cm at the perimeter band circumference; 53 cm circumference around the swim cap concavity with a top-of-dome-to-top-of-the-perimeter band depth of 18 cm and material thickness having low tear and low tensile strength with low puncture resistance making them easy to tear and too small to cover completely long, thick, curly, kinky, coarse, voluminous and/or high-maintenance hair Types 3 and 4; braids, rolled locks or dreadlocks that swell like natural sponges when wet to protect hair from water exposure while swimming or participating in water-sourced activities. Having higher tear, tensile strength, and puncture resistance than standard latex and silicone adult swim caps, standard rubber adult swim caps have dimensions that average less than for standard latex and silicone adult swim caps. A summary of hair types is discussed here: https://www.hshairclinic.co.uk/hair-loss/all-about-hair/types-of-hair/The common "Wet hair first" instruction ignores the existence of people who need a swim cap to cover their dry hair in order to keep it dry.

Swim cap perimeters with straight edges positioned over or across or engulfing the ears make it challenging to achieve and maintain a water-tight seal at the hair line as in U.S. Pat. No. 9,555,288 B1, and present an alien appearance to the wearer's face as in U.S. Pat. No. 9,538,799 B2. Chin straps provide security of fit at the cost of comfort, aesthetics, and style as in U.S. Pat. No. 3,381,305.

Swim caps advertised as XL and/or for long hair or dreadlocks have domed concavities with soft Shore A durometers flop around and migrate during vigorous movement as in U.S. Pat. No. 2015/0209621 A1 and U.S. Pat. No. 2016/0066639. Swim caps having larger than the standard dimensions with domed concavities with hard Shore D durometers don't conform to the hair and head as in U.S. Pat. No. 3,503,076. Waterproof hair wraps with overlapping panels can be unwieldy when moving through the water, and collapse in ways that are inconvenient for the wearer when submerged.

Swim cap concavities in the form of floppy beret and shower cap shapes also collapse in inconvenient ways when submerged as in U.S. Pat. Nos. 3,996,621 A and 5,566,689 A.

Swim caps with multiple chambers, various tubes, straps, and pouches can be complicated, confusing, and inconvenient as in U.S. Pat. No. 2015/0209621 A1, CA 2934692A1, and GB 2484437A. Cinching features that partially encompass the circumference of the head at or below the hair line exert an uneven, insufficient distribution of pressure toward achieving and maintaining a water-tight seal for a secure and stable fit around a wearer's hair and head as in U.S. Pat. No. 2017/0042267.

Shallow, perforated, and/or too few ribbed bands at the perimeter provide insufficient gripping strength to establish and maintain a barrier to water seepage at the hair line as in U.S. Pat. No. 1,771,178A.

Having hard Shore D durometers that make them resistant to indentation, expandable containers with accordion pleats for storing food and objects won't conform to the contours of a person's head as in U.S. Pat. No. 2006/0266754 A1. Trash bags comprising materials as in U.S. Pat. No. 2005/0175805 A1 having high tear strength, high tensile strength, and high puncture resistance with soft Shore A durometers are inappropriate and dangerous as head gear.

BRIEF SUMMARY OF THE INVENTION

As used herein, the terms "water-tight expandable swim cap with cinching feature" and "water-tight cap" are interchangeable with the term "swim cap" in the following.

The objective of the present embodiment is to provide a water-tight swim cap that accommodates a range of hair types, particularly thick, curly, long, kinky, coarse, voluminous and/or high-maintenance hair, including chemically treated hair and/or braids, rolled locks or dreadlocks for a fit that's secure, stable, and streamlined with possibilities for decorative elements.

The first embodiment solves the problem of insufficient volume capacity by having an elongated swim cap concavity of dimensions greater than those on standard swim caps with sufficient space for containing an abundant mass of dry hair completely inside the swim cap concavity.

A second aspect of expandable side walls with flexible pleats expands and contracts according to the dimensions of the wearer's head and volume of hair to contain a wearer's hair close to the scalp.

A third aspect of a draw cord sleeve as a designated enclosed track for a draw cord with knotted ends and draw cord accessories extending from the draw cord sleeve openings at the back to provide adjustable tension as a water barrier and means of creating a secure and stable fit around a wearer's head following the circumference of their hair line.

A fourth aspect of an elastic ribbed perimeter band having a plurality of rows of grooved channels with ear notches below the draw cord sleeve establishes and maintains continuous contact between a wearer's skin below the hair line for a water-tight fit with notches positioned behind the shells of a wearer's ears.

All aspects work cooperatively to accommodate various head dimensions and hair mass volumes and hair types to establish and maintain a water-tight fit that is comfortable, convenient, compact, and remains secure while submerged and moving through the water.

A fifth aspect related to the draw cord, knotted draw cord ends, and draw cord accessory provides barriers to slippage of the draw cord ends into the draw cord sleeve and possibilities for decorative elements.

Figure 1A:
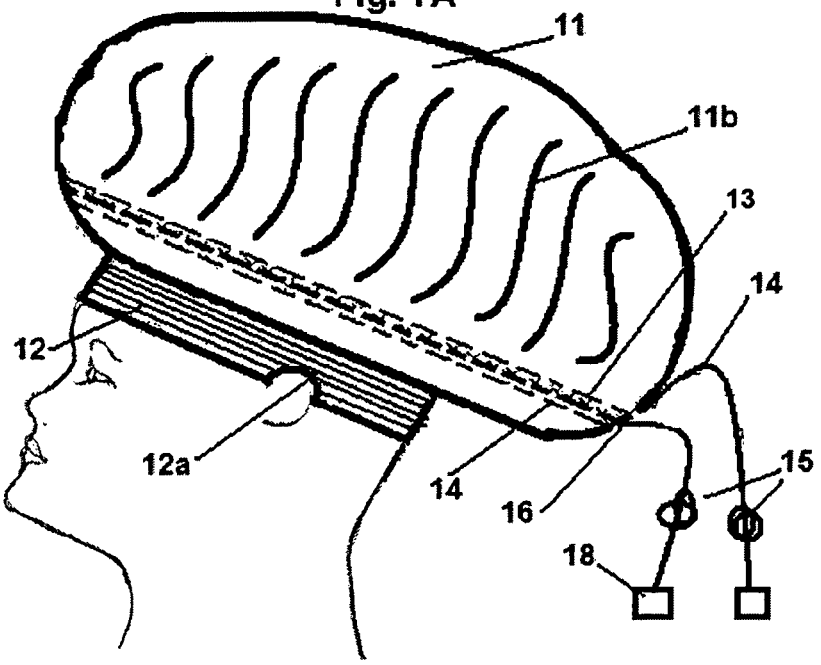
FIGS. 1A-1B show aspects of the water-tight expandable swim cap with cinching feature on a wearer's head from a side view.

Images in the drawings are for illustrative purposes and not rendered in actual size; and may not reflect mathematical scale and proportions.

DRAWINGS—REFERENCE NUMERALS

11 elongated swim cap concavity expandable walls
11*a* elongated swim cap concavity
11*b* flexible pleats in elongated swim cap concavity expandable walls
12 elastic ribbed perimeter band with ear notches
12*a* ear notches in the elastic ribbed perimeter band
13 internal draw cord sleeve
14 draw cord
15 knotted draw cord end
16 draw cord sleeve openings
17 external open weave draw cord sleeve
18 draw cord accessory

DETAILED DESCRIPTION OF THE INVENTION

FIGS. 1A, 2, 3A, and 4—First Embodiment

One embodiment of the swim cap is illustrated in FIG. 1A (side view). The swim cap has elongated expandable side walls 11 of elastic moisture impervious material that expands and contracts without rupturing or tearing under intended usage. An elastic ribbed perimeter band 12 of the elongated swim cap concavity 11*a* has curved ear notches 12*a* and a plurality of rows of grooved channels. Above the elastic ribbed perimeter band 12 an internal draw cord sleeve 13 follows the circumference of the swim cap concavity 11*a* as an enclosed track for a draw cord 14 with a knotted draw cord end 15. A draw cord accessory 18 is attached beyond the knotted draw cord end 15.

Figure 2:
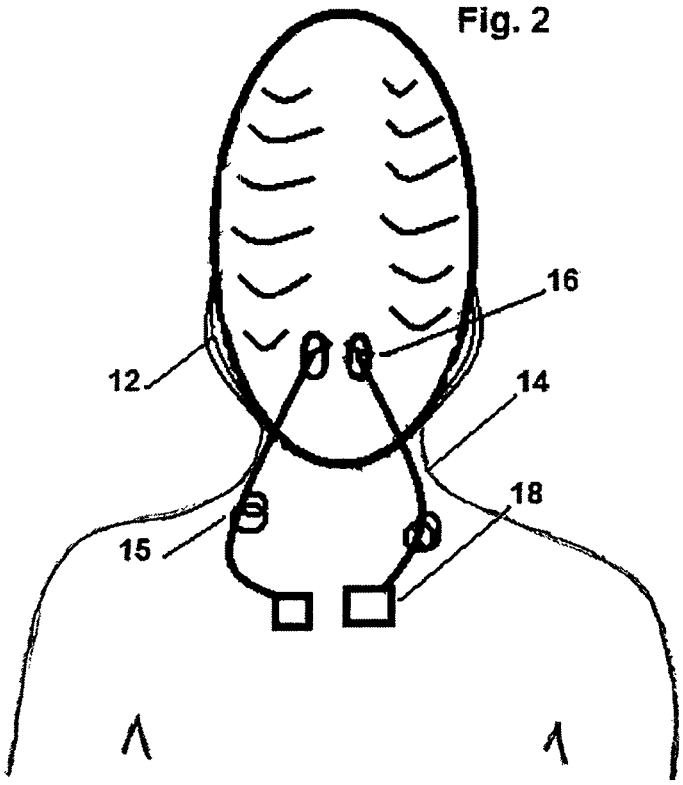
FIG. 2 shows the cinching feature with draw cord untied and the elastic ribbed perimeter band with grooved channels for gripping skin beneath the hair line.

The back of the swim cap is illustrated in FIG. 2 (back view). The draw cord 14, knotted draw cord ends 15, and draw cord accessory 18 extend from two draw cord sleeve openings 16.

Figure 3A:
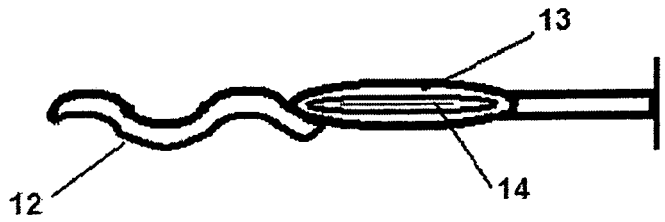
FIGS. 3A-3B show aspects of the draw cord sleeve for the draw cord as internal and external to the swim cap perimeter

The elastic ribbed perimeter band 12, internal draw cord sleeve 13, and draw cord 14 are illustrated in a cross section in FIG. 3A.

Figure 4:
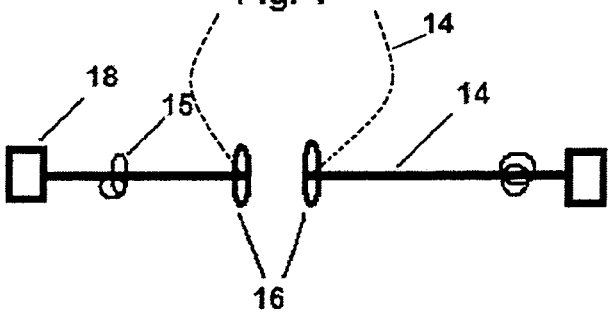
FIG. 4 shows the draw cord sleeve openings, untied draw cord, knotted draw cord ends, and draw cord accessory.
Figure 5:
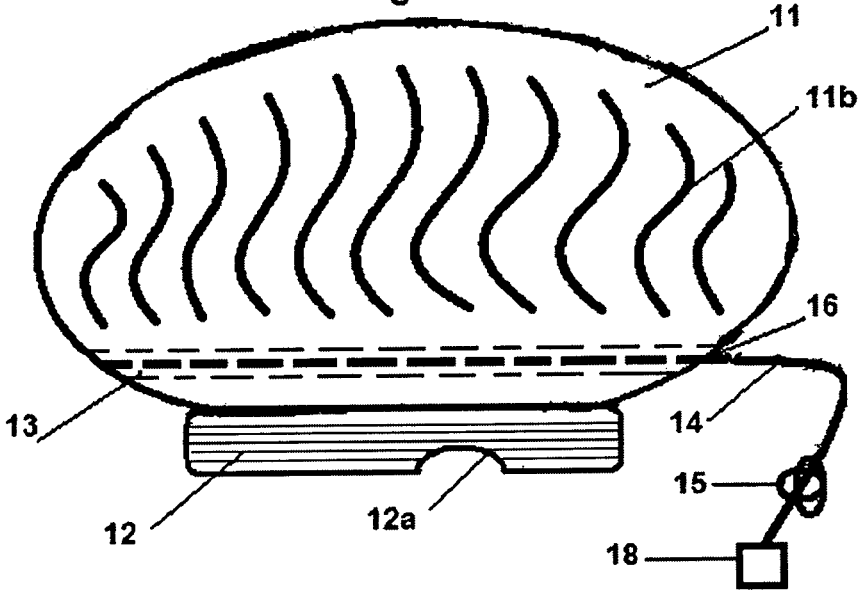
FIG. 5 shows a side view of the water-tight expandable swim cap with cinching feature.
Figure 6:
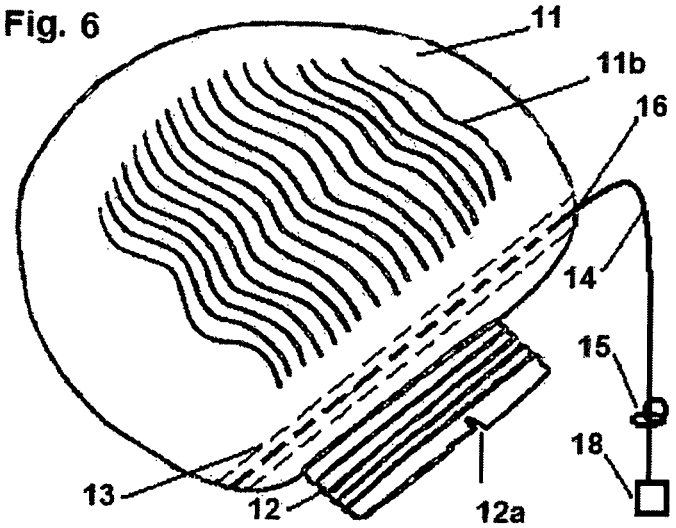
FIG. 6 shows an angled side view of the water-tight expandable swim cap with cinching feature.
Figure 7:
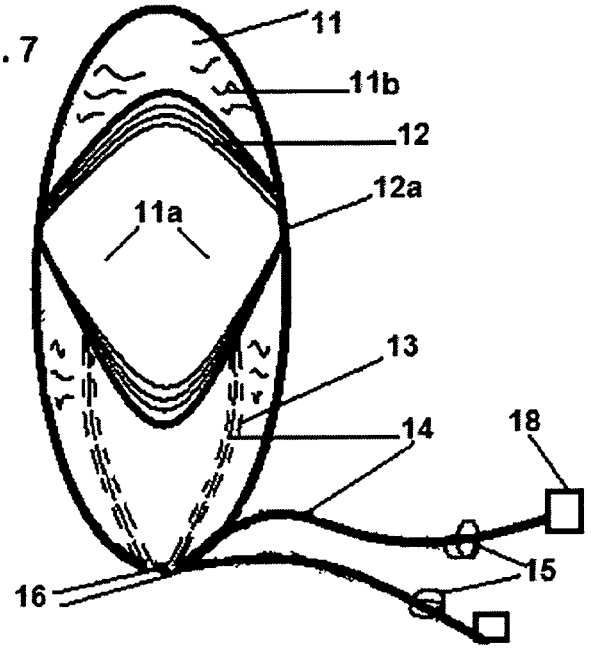
FIG. 7 shows the inner concavity of the swim cap from a bottom view.
Figure 8:
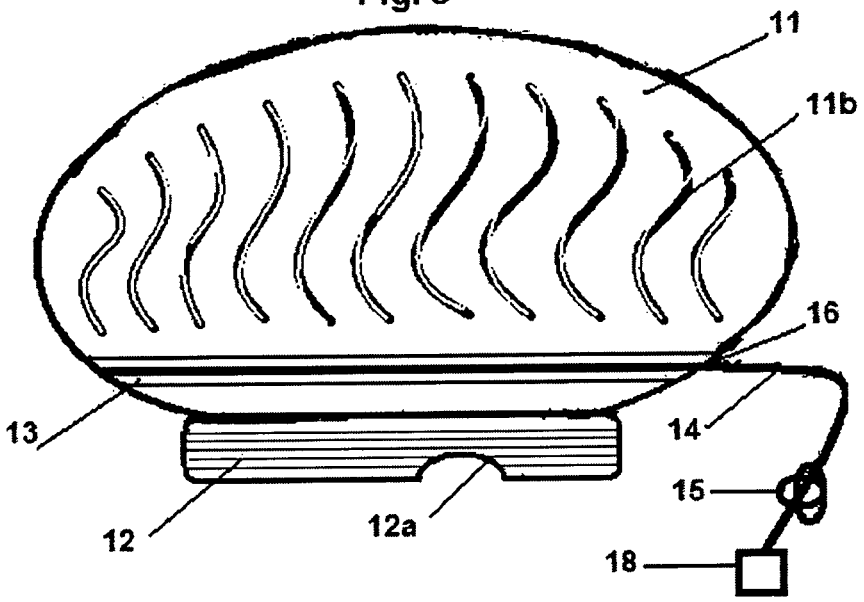
FIG. 8 shows an interior cross section view of the elongated swim cap concavity expandable wall and flexible pleats.

The draw cord sleeve openings 16, knotted draw cord ends 15, draw cord 14, and draw cord accessory 18 are illustrated in FIG. 4.

Operation—FIGS. 1, 2, 3, 4, 7, 9

The manner of applying the swim cap (FIG. 1) to a wearer's head is identical to that of standard swim caps in present use. Namely, one first spreads the elastic ribbed perimeter band 12 to access the swim cap concavity 11*a* (FIG. 7) in order to place the swim cap on head and over hair and scalp, positioning the ear notches 12*a* behind the shells of the ears at the hair line. Next, tuck all hair strands upward inside the elongated swim cap concavity 11*a* above the elastic ribbed perimeter band 12, ear notches 12*a*, and internal draw cord sleeve 13. Remove excess air in the elongated swim cap concavity 11*a* by creating a gap between the elastic ribbed perimeter band 12 and the skin, then press down on the top of the elongated swim cap concavity walls 11*b*. Adjust the elastic ribbed perimeter band 12 to rest against the skin below the hair line around the circumference of the head. Pull the draw cord 14 (FIGS. 2 and 4) to the desired tension, then tie into a bow or a double bow (FIG. 9).

To remove the swim cap (FIGS. 1, 2, 3, and 9), one first unties the draw cord 14, then pulls at the internal draw cord sleeve 13 and the elastic ribbed perimeter band 12 to interrupt the water-tight seal at the hair line, then lift the elongated swim cap concavity walls 11 up and off a wearer's hair and head.

Figure 9:
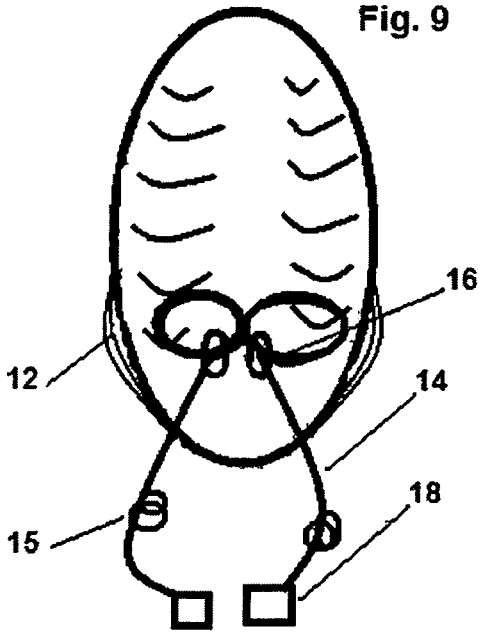
FIG. 9 shows the cinching feature tied.

FIGS. 2, 4, 9—Additional Embodiments

The possible additional embodiments include making the draw cord 14 length sufficient to encircle the circumference of the head outside of the internal draw cord sleeve 13 or external draw cord sleeve 17 once or more loops around the outside of the elongated swim cap concavity walls 11 to increase the variety of ways to secure the swim cap into a stable position on a wearer's head and hair.

Figure 1B:
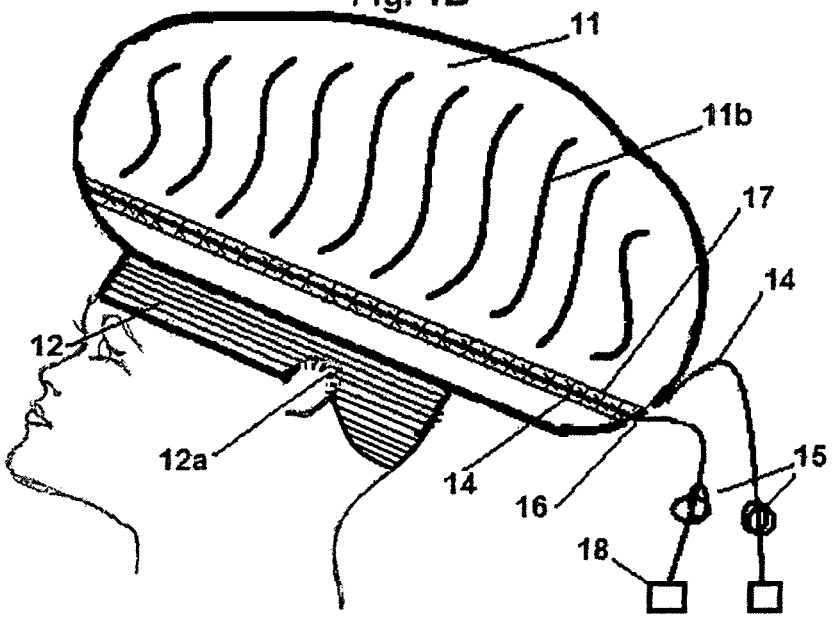
Figure 3B:
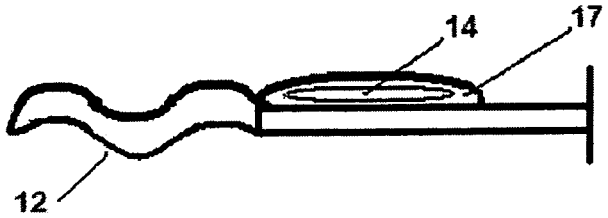

FIGS. 1B and 3B—Alternative Embodiments

There are various possibilities relative to the configuration of the draw cord sleeve. FIG. 1B (side view) illustrates an external draw cord sleeve 17 with an open weave casing that permits water and moisture to escape, allowing the enclosure to dry completely to prevent accumulation of mold and mildew. It also makes it convenient to remove the draw cord 14 and/or reinsert it if necessary. Being able to see the draw cord 14 through the open weave of the external draw cord sleeve 17 adds a decorative element.

Extending the back portion of the elastic ribbed perimeter band 12 to dip lower on the nape of a wearer's neck is shown in FIG. 1B.

Material for the draw cord 14 may be elastic or inelastic.

The elastic ribbed perimeter band 12, external draw cord sleeve 17, and draw cord 14 are illustrated in an axial cross section in FIG. 3B.

The flexible pleats 11*b* in the elongated swim cap concavity walls 11 may be straight or angular and/or placed at various distance intervals.

Advantages

From the preceding description, numerous advantages of some embodiments of my water-tight expandable swim cap with cinching feature become evident:

(a) A single-compartment device with a synchronicity of elements that work cooperatively to offer its wearer easy, convenient protection from moisture exposure with a water-tight seal, a secure fit that is stable, a streamlined profile, and aesthetic possibilities offered by unobstructed visibility of and access to the ears.

(b) The elastic ribbed perimeter band with ear notches establishes and maintains continuous contact with a wearer's skin below the hair line around the circumference of a wearer's head, which forms a water-tight barrier that's uninterrupted by laying behind the ears instead of laying across or partially enclosing or completely engulfing the ears.

(c) The draw cord inside the internal or external draw cord sleeve allows its wearer to adjust the tension of the fit according to their personal requirements for securing a stable fit, also adding another barrier to water seepage into the elongated swim cap concavity.

(d) The elongated swim cap concavity expandable walls made of moisture impervious material that expands and contracts without rupturing during designated usage gently compresses the confined hair, which streamlines a wearer's profile as they move through the water when submerged.

(e) The draw cord accessory acts as a cord stop and allows wearers to personalize the appearance of their swim cap with decorative or fashionable or licensed logo charms or baubles.

CONCLUSION, RAMIFICATIONS, AND SCOPE

Accordingly, the reader will see that the water-tight expandable swim cap with cinching feature of various embodiments provides easy, convenient protection of a wearer's hair and scalp from water exposure, provides a secure and stable fit that's adjustable, while the elongated swim cap concavity walls and flexible pleats gently compress the hair to a wearer's head to streamline their profile as they move through the water when submerged.

Furthermore, the water-tight expandable swim cap with a cinching feature has the additional advantages in that:

it provides protection from water exposure to hair and scalp by combining form with function to provide layers of barriers to water seepage because keeping dry hair dry is its priority;

it provides accommodation of fit and security for wearers with a range of head sizes and hair types, especially wearers with very thick, curly, kinky, coarse, long, voluminous and/or high-maintenance hair including chemically treated hair, braids, rolled locks, and dreadlocks;

it provides adjustability for a stable fit that's also comfortable; and it provides possibilities for distinctive decorative elements.

Although the preceding description contains many specificities, these should not be construed as limiting the scope of the embodiments but as simply providing illustrations of some of several embodiments. For example, the flexible pleats in the elongated swim cap concavity walls can be straight instead of curved, etc.

Thus the scope of the embodiments should be determined by the appended claims and their legal equivalents, rather than by the examples given.

I claim:

1. A water-tight cap comprising:

an elongated concave dome comprising expandable walls and a bottom edge, the expandable walls comprising flexible pleats incorporated therein, a bottom edge of each flexible pleat being spaced above the bottom edge of the dome;

an elastic ribbed perimeter band for fitting below the hairline, the elastic ribbed perimeter band comprising ear notches configured to keep a wearer's ears uncovered by the cap when donned and a plurality of grooved channels configured to create a moisture barrier with a head of the wearer; and an internal draw cord sleeve containing a draw cord comprising knotted draw cord ends, the internal draw cord sleeve circumnavigating a circumference of the dome and located between and spaced apart from the bottom edge of each flexible pleat and a top edge of the elastic ribbed perimeter band;

whereby the cap is configured to contain a hair mass of the wearer to protect the hair mass and scalp from exposure to moisture.

2. The cap of claim 1, further comprising a draw cord accessory located on each knotted end of the draw cord.

* * * * *